US007559287B2

(12) United States Patent
Tsumiyama et al.

(10) Patent No.: US 7,559,287 B2
(45) Date of Patent: Jul. 14, 2009

(54) PERSONAL WATERCRAFT

(75) Inventors: Yoshinori Tsumiyama, Miki (JP); Takahide Komoriya, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/517,548

(22) Filed: Sep. 5, 2006

(65) Prior Publication Data

US 2007/0051289 A1 Mar. 8, 2007

(30) Foreign Application Priority Data

Sep. 6, 2005 (JP) ..... 2005-257624

(51) Int. Cl.
*B63B 35/73* (2006.01)
*B63B 19/16* (2006.01)

(52) U.S. Cl. ..... 114/55.53; 114/201 R

(58) Field of Classification Search ..... 114/55.53, 114/361, 364, 201 R, 382; 206/349, 405
See application file for complete search history.

(56) References Cited

U.S. PATENT DOCUMENTS 1,368,432 A * 2/1921 Hahn ..... 180/313
D228,898 S * 10/1973 Wickel, Sr. ..... D12/425
5,894,810 A * 4/1999 Orr ..... 114/343
6,779,474 B2 * 8/2004 Nakagawa et al. ..... 114/55.57

FOREIGN PATENT DOCUMENTS

JP 2000-203489 7/2000

* cited by examiner

*Primary Examiner*—Lars A Olson
*Assistant Examiner*—Daniel V Venne
(74) *Attorney, Agent, or Firm*—Alleman Hall McCoy Russell & Tuttle LLP

(57) ABSTRACT

A personal watercraft including a body including a hull and a deck covering the hull from above, an engine room formed in an interior of the body, an engine hood mounted over an opening that is formed on the deck to be located at an upper region of the engine room, the engine hood being configured to open and close the opening, and a tool case mounting portion mounted on a wall surface of the engine hood which faces the engine room, the tool case mounting portion being configured to hold a tool case that accommodates a tool kit for the watercraft.

3 Claims, 6 Drawing Sheets

PERSONAL WATERCRAFT

TECHNICAL FIELD

The present invention relates to a personal watercraft (PWC) which has an engine room that is formed in an interior of a body of the watercraft to accommodate an engine and is covered with an engine hood from above.

BACKGROUND ART

In recent years, jet-propulsion personal watercraft (PWC) have been widely used in leisure, sport, rescue activities, and the like. Typically, the personal watercraft is equipped with an engine mounted in an engine room formed in a space defined by a hull and a deck, and a water jet pump that pressurizes and accelerates water sucked from a water intake generally provided on a hull bottom surface and ejects it rearward from an outlet port, thereby propelling the personal watercraft.

The personal watercraft is equipped with a tool kit such as a spanner for the purpose of maintenance of the engine, etc. The tool kit is formed of iron or the like rather than stainless steel to increase stiffness. Since the personal watercraft travels in the water, the maintenance tool kit is accommodated in a tool case which is accommodated in a closed space such as a storage box for the purpose of rust-proofing (see, e.g., Japanese Laid-Open Patent Application Publication 2000-203489).

However, in order to maintain the engine in the personal watercraft constructed such that the tool case is accommodated in the storage box provided separately from the engine room, a user must not only open an engine hood closing the engine room but open a lid of the storage box to take out the tool case. This causes unduly burdensome preparation for maintenance and degrades maintenance efficiency.

SUMMARY OF THE INVENTION

The present invention addresses the above described conditions, and an object of the present invention is to provide a personal watercraft that enables a tool kit to be easily taken out for maintenance of an engine to improve maintenance efficiency.

According to the present invention, there is provided a personal watercraft comprising a body including a hull and a deck covering the hull from above; an engine room formed in an interior of the body; an engine hood mounted over an opening that is formed on the deck to be located at an upper region of the engine room, the engine hood being configured to open and close the opening; and a tool case mounting portion mounted on a wall surface of the engine hood which faces the engine room, the tool case mounting portion being configured to hold a tool case that accommodates a tool kit for the watercraft.

In such a construction, since the tool case is attached on the wall surface of the opened engine hood that faces the engine room in a case where the user opens the engine hood to, for example, maintain the engine, the user can easily reach the tool case without opening a lid of a storage box of the watercraft. Therefore, the user can easily take out the tool kit for maintenance, and thus maintenance efficiency improves. In addition, since the user can easily access the wall surface of the opened engine hood which faces the engine room, maintenance efficiency improves as compared to a case where the tool case is attached to, for example, a bottom portion in the interior of the engine room.

The engine hood may be mounted at an end portion thereof to the body by a hinge member and may be configured to be vertically pivotable to be opened and closed, and the tool case mounting portion is mounted on the wall surface of the engine hood which is located on the hinge member side.

In such a construction, since the tool case, which has a weight, is disposed closer to a pivot of the hinge, a force exerted by the user to raise up and open the engine hood around the pivot can be reduced. The hinge member may be suitably mounted at a front portion of the engine hood.

A pair of swelling portions may be configured to protrude from the wall surface of the engine hood which faces the engine room and may be located on both sides of the tool case mounting portion.

In such a construction, by mounting the tool case to the tool case mounting portion, the tool case can be positioned in a lateral (width) direction of the body and is restricted not to move by the swelling portions of the engine hood. Therefore, the tool case can be stably mounted. Since the swelling portions are integral with the engine hood, there is no need for a member for positioning the tool case in the lateral direction. As a result, the components do not increase in number.

An air duct configured to allow an outside of the engine hood to fluidically communicate with the engine room therethrough may be respectively disposed in interiors of the swelling portions.

In such a construction, since a space formed by the swelling portion is used as a space into which the air duct is inserted, a space efficiency in the interior of the engine room improves.

The tool case mounting portion may include a pair of case receiver members each of which is mounted on the wall surface of the engine hood and is configured to form a concave portion, and a cushion member that may be attached on the wall surface of the engine hood and is located between the case receiver members. With the tool case inserted into the concave portion of each of the case receiver members and an outer surface of the tool case on the case receiver member side pressed against the cushion member, the tool case may be configured to be retained in such a manner that a band is applied to an outer surface of the tool case which is on an opposite side of the outer surface on the case receiver side, and both end portions of the band are engaged with both end portions of the case receiver member.

In such a construction, since the tool case inserted into the concave portion of the case receiver member is pressed against the cushion member and retained, it does not substantially move even when a vibration occurs in the watercraft. As a result, occurrence of a noise can be inhibited.

The engine hood may have, at a front portion thereof, a protruding portion extending downward from an inner surface of an upper wall thereof. The protruding portion may have an inward wall surface forming a front surface of the engine room which faces the engine room and an outward wall surface located forward of the inward wall surface. The tool case mounting portion may be mounted on the inward wall surface and the hinge member is mounted on the outward wall surface.

In such a construction, the tool case mounting portion and the hinge member can be stably mounted to the front portion of the engine hood.

The above and further objects and features of the invention will more fully be apparent from the following detailed description with accompanying drawings.

DETAILED DESCRIPTION OF THE EMBODIMENTS

Figure 1:
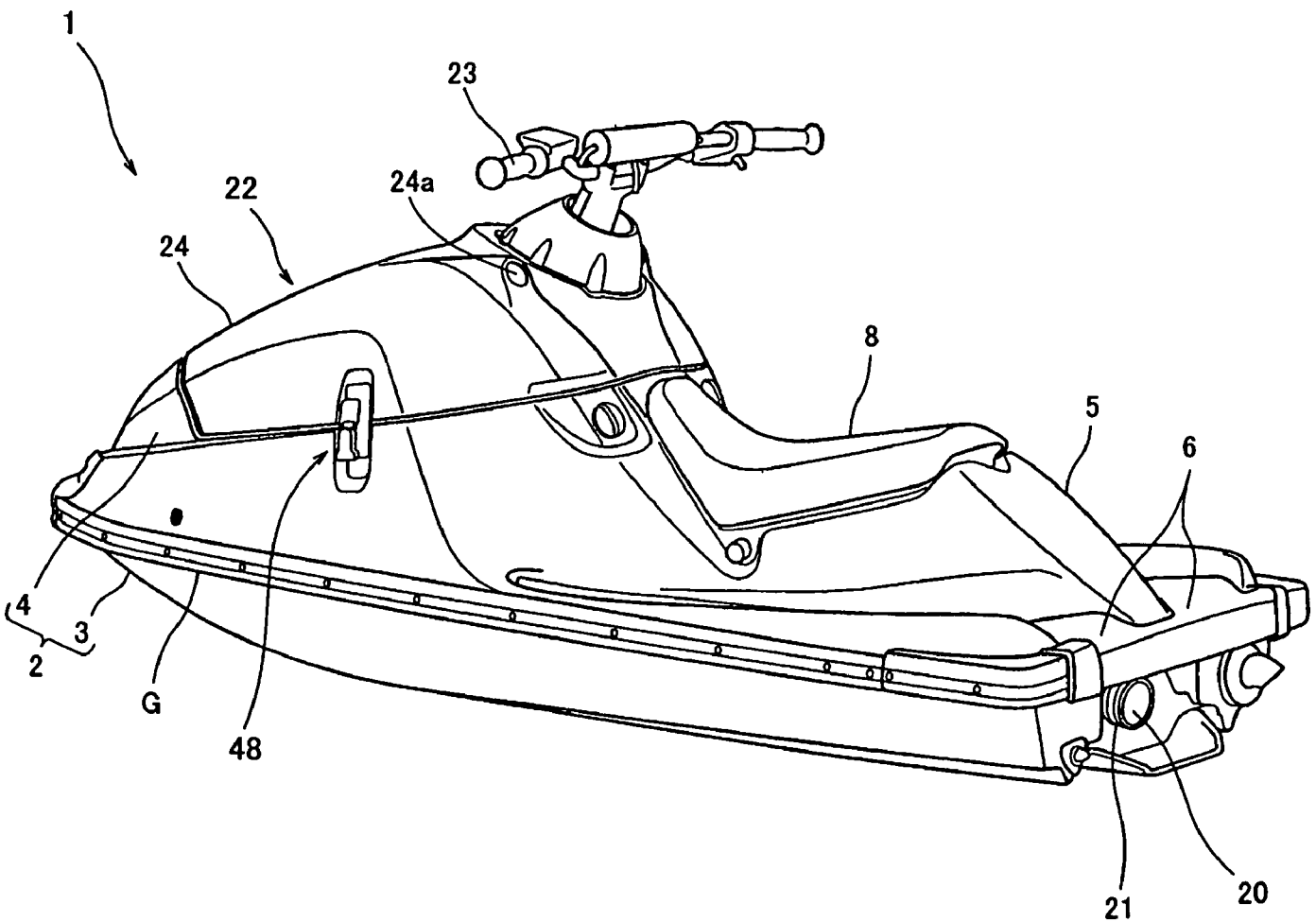
FIG. 1 is a perspective view of a personal watercraft according to an embodiment of the present invention, as viewed from the left and behind.
Figure 2:
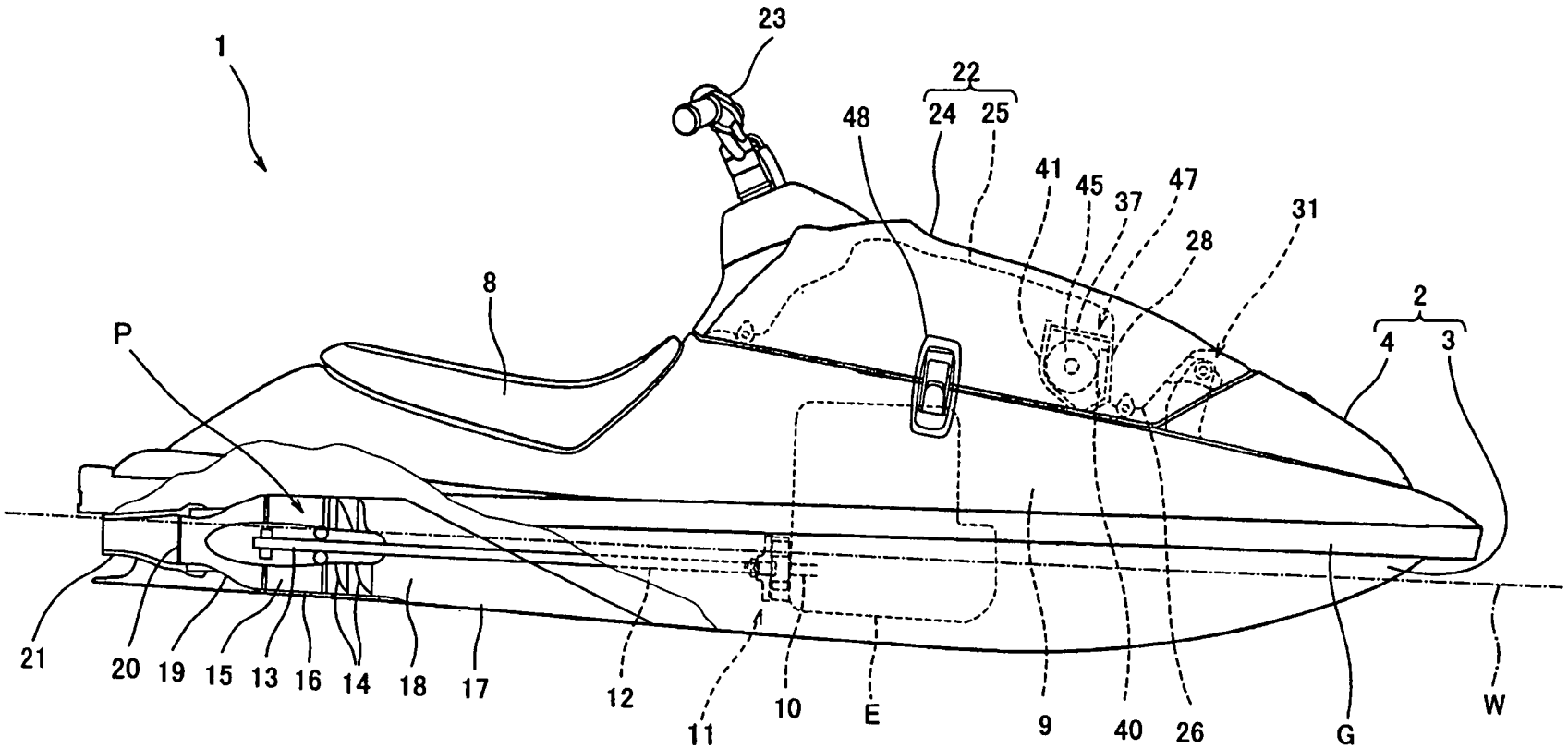
FIG. 2 is a side view of the personal watercraft of FIG. 1, a part of which is cut away.
Figure 3:
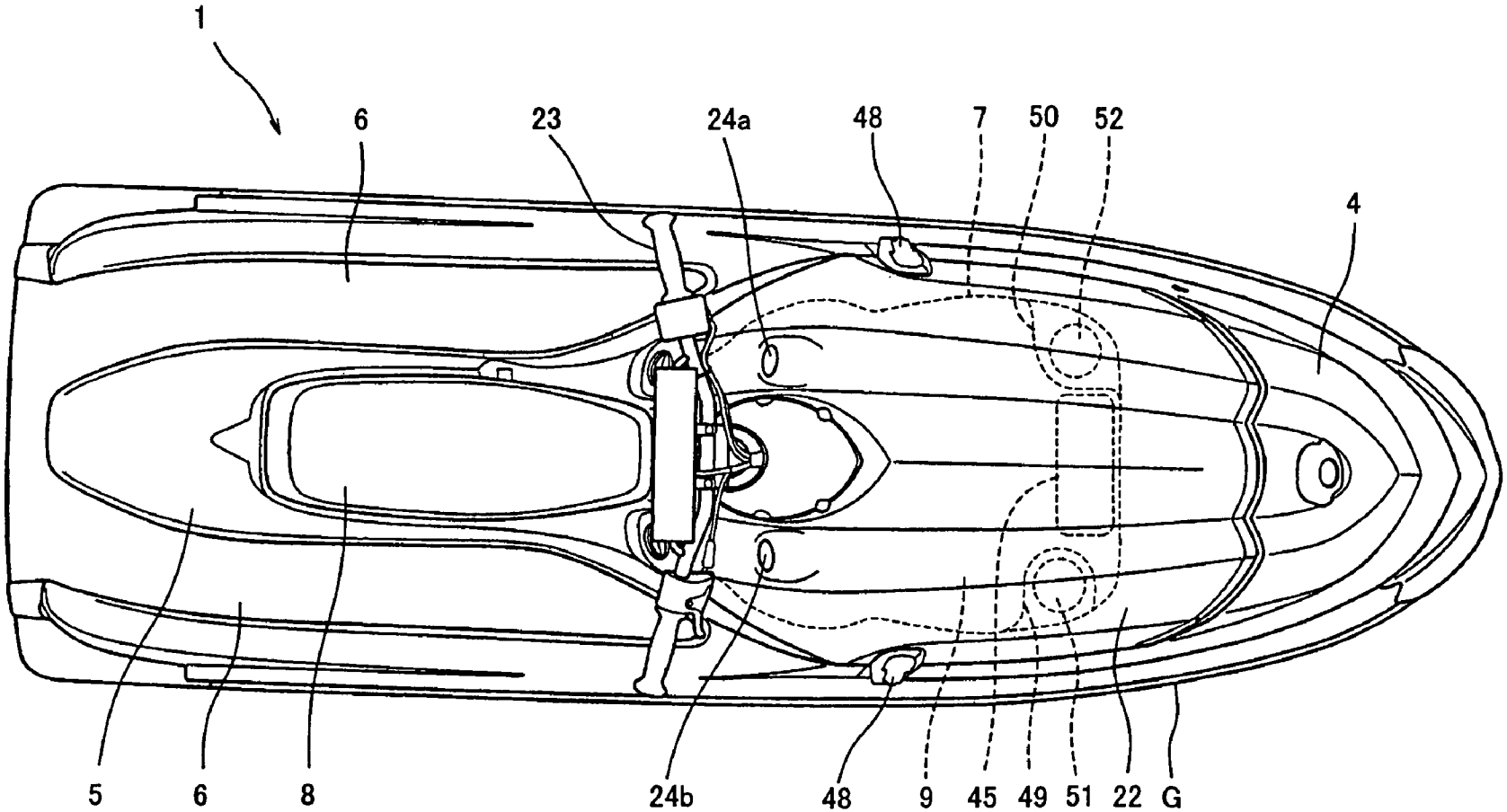
FIG. 3 is a plan view of the personal watercraft of FIG. 1.

Hereinafter, embodiments of the present invention will be described with reference to the drawings. FIG. 1 is a perspective view of a personal watercraft 1 according to an embodiment of the present invention, as viewed from left and behind. FIG. 2 is a side view of the personal watercraft 1 of FIG. 1, a part of which is cut away. FIG. 3 is a plan view of the personal watercraft 1 of FIG. 1. As used herein, the term "directions" refers to directions from the perspective of a rider straddling the watercraft 1.

Turning now to FIGS. 1, 2, and 3, the personal watercraft 1 is a straddle-type personal watercraft equipped with a seat 8 straddled by a rider. A body 2 of the watercraft 1 includes a hull 3 and a deck 4 covering the hull 3 from above. A center region in a width (lateral) direction of a rear portion of the deck 4 protrudes upward to form a protruding portion 5. The seat 8 is mounted over the protruding portion 5. A deck floor 6 is formed on opposite (right and left) sides in the width direction of the protruding portion 5 and is lower than the protruding portion 5 and is substantially flat to allow the rider to put the rider's feet thereon. A line at which the hull 3 and the deck 4 are connected over the entire perimeter thereof is called a gunnel line G. As shown in FIG. 2, the gunnel line G is located above a waterline W of the watercraft.

As shown in FIG. 3, a deck opening 7 is formed at a substantially center section in a lateral direction of a front portion of the deck 4 at an upper portion of the body 2. As shown in FIG. 2, an engine hood 22 is mounted over the deck opening 7 and is configured to be pivotable around a hinge member 31 attached on a front portion thereof. The engine hood 22 is locked to the deck by a locking member 48. A space defined by the hull 3 and the deck 4 below the deck opening 7 is an engine room 9 in which the engine E is mounted. The engine room 9 is located in front of the seat 8. A tool case 45, which will be described later, is attached on a front portion of a wall surface of the engine hood 22 that faces the engine room 9. As shown in FIG. 3, air holes 24*a* and 24*b* through which air is introduced into the engine room 9 from outside are formed at a rear portion of the engine hood 22 and are located on right and left sides of the handle 22.

Turning to FIG. 2 again, a crankshaft 10 of the engine E extends in a longitudinal direction of the body 2. An output end portion of the crankshaft 10 is coupled to a propeller shaft 12 through a coupling member 11. The propeller shaft 12 is coupled to a pump shaft 13 of a water jet pump P disposed at a rear portion of the body 2. The pump shaft 13 rotates in association with rotation of the crankshaft 10. An impeller 14 is attached on the pump shaft 14. Faring vanes 15 are disposed behind the impeller 14. The impeller 14 is covered with a tubular pump casing 16 at an outer periphery thereof.

A water intake 17 is provided on a bottom surface of the hull 3 of the body 2. The water intake 17 is connected to the pump casing 16 through a water passage 18. A pump nozzle 19 is provided on a rear side of the body 2 and is coupled to the pump casing 16. The pump nozzle 19 has a cross-sectional area that is gradually reduced rearward, and an outlet port 20 is provided on a rear end of the pump nozzle 19. A steering nozzle 21 is coupled to the outlet port 20 of the pump nozzle 19 so as to extend rearward and is configured to be pivotable to the right or to the left.

In the above constructed personal watercraft 1, water outside the watercraft is sucked from the water intake 17 provided on the bottom surface of the hull 3 and is fed to the water jet pump P. Driven by the engine E, the impeller 14 of the water jet pump P pressurizes and accelerates the water. The fairing vanes 15 guide water flow behind the impeller 14. The water is ejected rearward from the outlet port 20 of the pump nozzle 19 and through the steering nozzle 21. As the resulting reaction, the watercraft obtains a propulsion force.

The steering handle 23 is mounted to protrude from the rear portion of the engine hood 22 provided with the tool case 45. The handle 23 is coupled to the steering nozzle 21 through a steering cable (not shown). When the rider rotates the handle 23 clockwise or counterclockwise, the ejection direction of the water being ejected through the steering nozzle 21 can be changed, and the watercraft can be correspondingly turned to any desired direction while the water jet pump P is generating the propulsion force.

Figure 4:
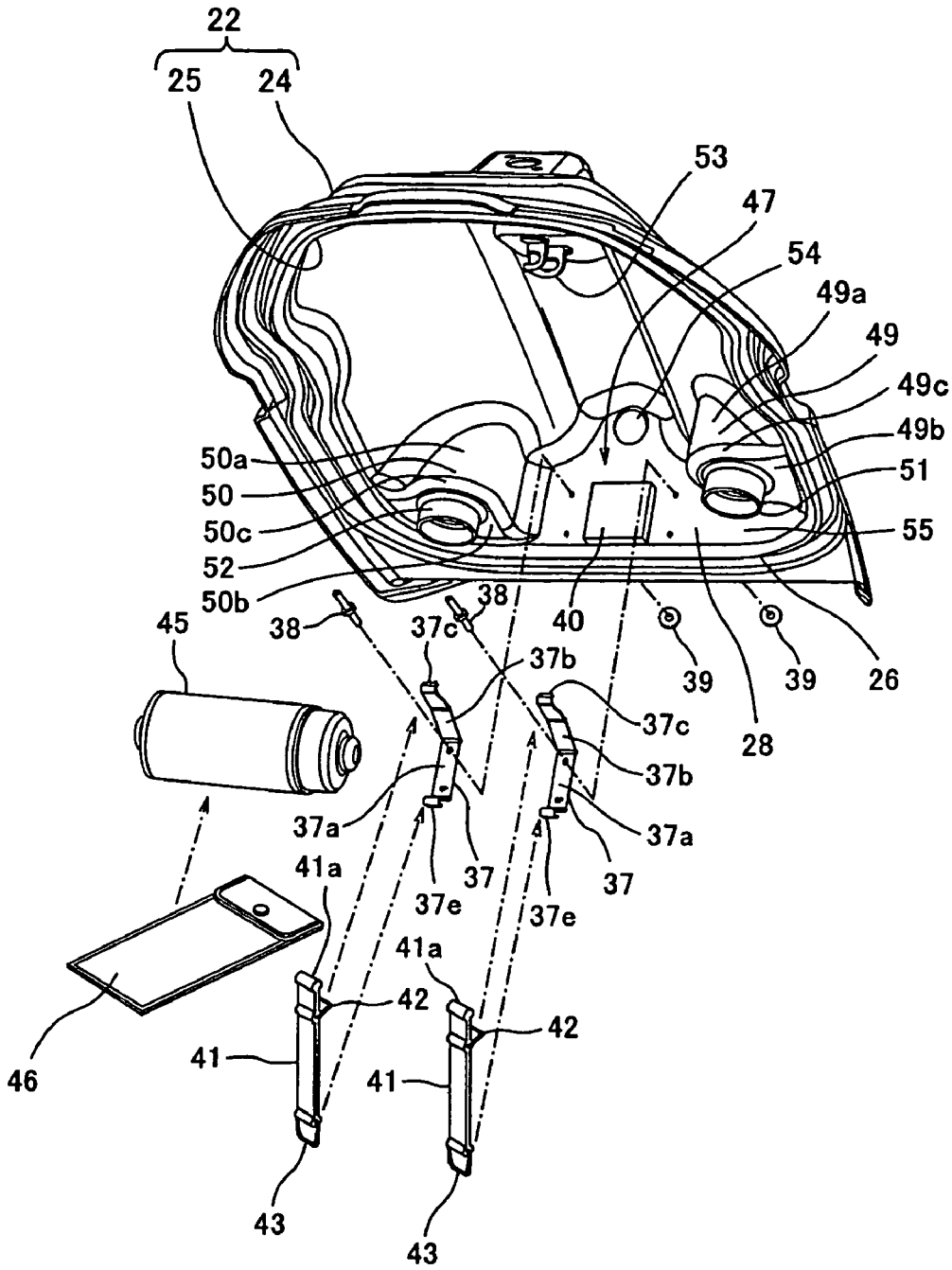
FIG. 4 is an exploded perspective view of an engine hood of the personal watercraft of FIG. 1 as viewed from downward.
Figure 6:
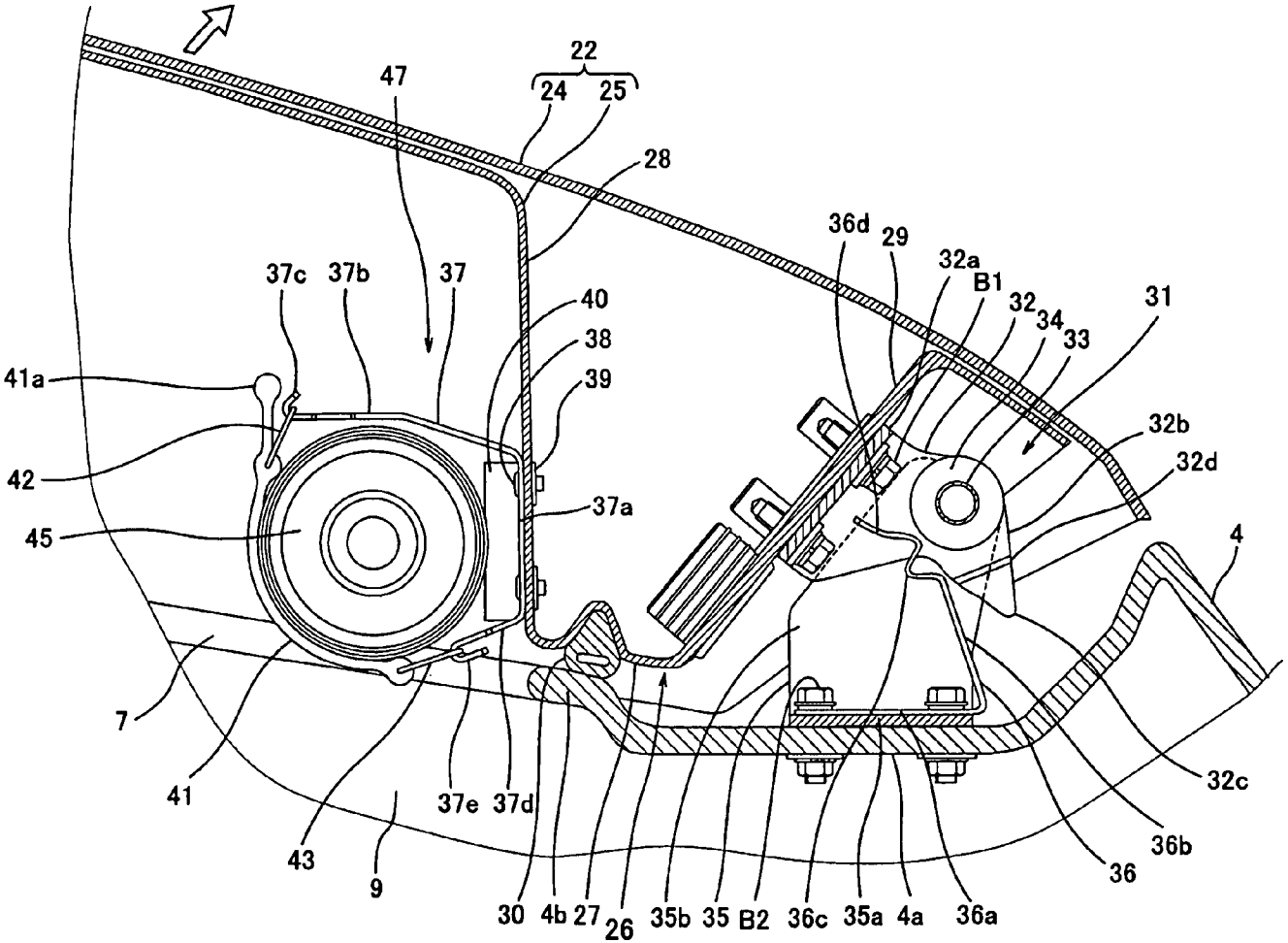
FIG. 6 is a cross-sectional view showing a front portion of the engine hood of the personal watercraft of FIG. 1.

The engine hood 22 to which the tool case 45 is mounted will now be described in detail. FIG. 4 is an exploded perspective view of the engine hood 22 as viewed from downward, to which the tool case 45 is not mounted yet. FIG. 6 is an enlarged cross-sectional view showing a front portion of the engine hood 22 of the watercraft 1.

Figure 5:
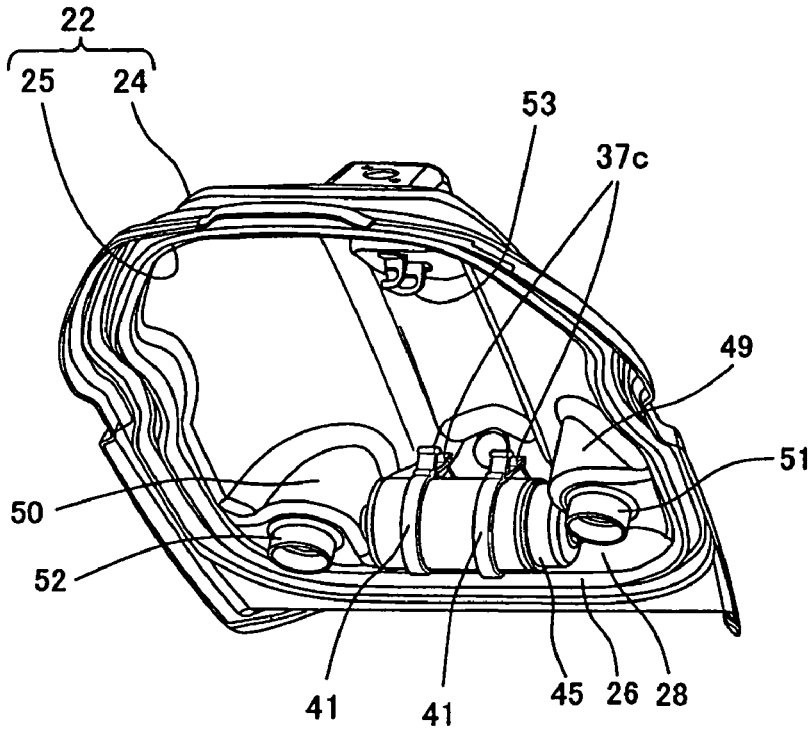
FIG. 5 is a perspective view showing a state in which a tool case is mounted to the engine hood of the personal watercraft of FIG. 1, as viewed from downward.

As shown in FIGS. 4 to 6, the engine hood 22 includes an outer panel 24 and an inner panel 25 which are bonded to each other with a space at a part of them to form a dome shape. A protruding portion 26 is formed at a front portion of the inner panel 25 to protrude downward. As shown in FIG. 6, a waterproofing rubber seal member 30 is mounted to a bottom wall surface of the protruding portion 26. By closing the engine hood 22, the seal member 30 is pressed against an opening end portion 4*b* of an upper surface 4*a* of the deck 4 around the deck opening 7. The protruding portion 26 extends downward toward the deck 4 from an upper wall of the inner panel 25. The protruding portion 26 includes an inward wall surface 28 which is a front surface of a wall portion of the inner panel 25 that faces the engine room 9, an outward wall surface 29 provided to be located forward of and to be spaced apart from the inner wall portion 28, and a bottom wall surface 27 coupling a lower end of the inward wall surface 28 to a lower end of the outer wall surface 29. The inward wall surface 28 and the outward wall surface 29 are flat. As shown in FIG. 4, a cable insertion hole 54 for wiring a cable is provided at an upper region of the inner wall surface 28 of the inner panel 25, and a cable guide 53 protrudes from an upper wall surface of a rear portion of the inner panel 25.

As shown in FIG. 4, a swelling portion 50 is formed on a left side of the inward wall surface 28 of the protruding portion 26 and is configured to protrude inward integrally from a side wall portion of the inner panel 25. A swelling portion 49 is formed on a right side to be opposite to the swelling portion 50 and is configured to protrude inward from the side wall portion of the inner panel 25 with a small gap 55 between the swelling portion 49 and the inward wall surface 28. The swelling portions 49 and 50 respectively have side peripheral surfaces 49*a* and 50*a* for positioning the tool case 45 in a lateral (width) direction of the body 2, bottom surfaces 49*b* and 50*b* for closing the side peripheral surfaces 49*a* and 50*a* from below, and circular-arc shaped curved portions 49*c* and 50*c* respectively connecting the side peripheral surface 49*a* to the bottom surface 49*b* and connecting the side peripheral surface 50*a* to the bottom surface 50*b*. Air ducts 51 and 52 are inserted into the interior of the swelling portion 49 and into the interior of the swelling portion 50, respectively, and protrude downward through the bottom surfaces 49*b* and 50*b*, respectively. The air ducts 51 and 52 communicate with the air holes 24*a* and 24*b*, respectively, through air passages (not shown) formed in the space between the outer panel 24 and the inner panel 25.

The tool case 45 is disposed between the pair of swelling portions 49 and 50 of the engine hood 22. A tool case mounting portion 47 is provided on the inward wall surface 28 of the protruding portion 26 and is located between the swelling portions 49 and 50. The tool case mounting portion 47 includes a pair of case receiver members 37 fixed on the inward wall surface 28 of the protruding portion 26, and a cushion member 40 that is attached to the inward wall surface 28 to be located between the case receiver members 37 and is made of elastomer resin. Each case receiver member 37 is formed by bending a band-shaped metal piece to form a concave portion, and includes a fixed plate portion 37*a*, an upper plate portion 37*b* extending from an upper end portion of the fixed plate portion 37*a*, and a lower plate portion 37*d* extending from a lower end of the fixed plate portion 37*a*. The upper plate portion 37*b* and the lower plate portion 37*d* are respectively provided with an upper engaged portion 37*c* and a lower engaged portion 37*e* at upper and lower ends thereof, which are folded back outward to be away from each other. The case receiver member 37 is mounted to the inner panel 25 in such a manner that the fixed plate portion 37*a* is fastened to the inward wall surface 28 of the protruding portion 26 by rivets 38 and washers 39.

The tool case 45 is constructed of a cylindrical can, and accommodates the tool kit 46 comprised of a bag and a tool such as a spanner contained therein. As shown in FIGS. 5 and 6, the tool case 45 is inserted into the concave portions of the case receiver members 37 and comes into contact with the cushion member 40. In this state, bands 41 are applied to be wound around an outer surface of a rear side of the tool case 45 and engaged therewith, allowing the tool case 45 to be retained. To be specific, a ring-like upper engagement portion 42 is pivotally attached to an upper portion of each band 41 and a ring-like lower engagement portion 43 is pivotally attached to a lower portion of each band 41. In addition, an upper end portion 41*a* is provided on the band 41 so as to protrude upward from a mounting position of the upper engagement portion 42, for removably attaching the band 41 to the receiver member 37. The tool case 45 is retained between the case receiver member 37 and the band 41 in such a manner that the upper engagement portion 42 engages with the engaged portion 37*c* of the upper plate portion 37*b* and the lower engagement frame 43 engages with the engaged portion 37*e* of the lower plate portion 37*d*. To be specific, the band 41 presses the tool case 45 against the cushion member 40 to restrict forward and backward movement of the tool case 45. As shown in FIG. 5, the swelling portions 49 and 50 of the engine hood 22 are disposed on right and left sides of the tool case 45 to position the tool case 45 in the lateral direction. It should be appreciated that the distance between the pair of swelling portions 49 and 50 is set slightly larger than the width of the tool case 45 in the lateral direction.

As shown in FIG. 6, the hinge member 31 is mounted between the outward wall surface 29 of the protruding portion 26 of the engine hood 22 and a region of the upper surface 4*a* of the deck 4 which is located forward of the deck opening 7. The engine hood 22 is vertically pivotable around the hinge member 31. The tool case 45 is mounted to the inward wall surface 28 of the protruding portion 26 in the vicinity of the hinge member 31. By pivoting the engine hood 22 upward around the hinge member 31 to an open position, the user can easily access the tool case 45 from the side.

The hinge member 31 includes a hood bracket 32 fastened to the outward wall surface 29 of the protruding portion 26, a deck bracket 35 that is fastened to the upper surface 4*a* of the deck 4 to be located forward of the deck opening 7, and a rotational shaft 33 configured to rotatably couple the hood bracket 32 to the deck bracket 34 by a bushing 34.

The hood bracket 32 includes a fixed plate portion 32*a* fastened to the outward wall surface 29 of the protruding portion 26 by bolts B1 and a protruding plate portion 32*b* protruding forward from the fixed plate portion 32*a*. The protruding plate portion 32*b* has a width that reduces toward a tip end portion 32*c* that is circular-arc shaped. A step portion 32*d* is formed at an intermediate position of the protruding plate portion 32*b* and is bent in the lateral (width) direction of the body 2.

The deck bracket 35 includes a fixed plate portion 35*a* that is fastened to the upper surface 4*a* of the deck 4 to be located forward of the deck opening 7 by bolts B2 and a protruding plate 35*b* protruding upward from the fixed plate portion 35*a*. The bolts B2 are configured to fasten a leaf spring member 36 to the deck 4 together with the fixed plate portion 35*a*. The leaf spring member 36 is bent substantially in L-shaped in cross-section, and includes a fixed plate portion 36*a* that is fastened to the upper surface 4*a* of the deck 4 to be located forward of the deck opening 7 and a protruding plate portion 36*b* protruding upward from a front end of the fixed plate portion 36*a*. A concave portion 36*c* is formed at an intermediate region in the vertical direction of the protruding plate portion 36*b* and is bent in substantially U-shape in cross-section. An upper end portion 36*d* of the protruding plate portion 36*b* which is located higher than the concave portion 36*c* is bent backward greatly.

A procedure for carrying out maintenance of the engine E will now be described.

The user unlocks the locking member 48 (FIG. 1) and causes the engine hood 22 to be pivoted upward around the rotational shaft 33 of the hinge member 31 to be thereby opened. Thereby, the tip end portion 32*c* of the hood bracket 32 of FIG. 6 rotates while being pressed against the surface of the protruding plate portion 36*b* of the leaf spring member 36, and is finally fitted into and engaged with the concave portion 36*c*. Under this condition, the engine hood 22 is maintained in an open position with a predetermined angle if the user releases the hand from the engine hood 22. By opening the engine hood 22, the deck opening 7 is exposed, and the user can maintain the engine E through the deck opening 7. Since the tool case 45 is positioned on the inward wall surface 28 on the front side of the opened engine hood 22, the user can easily reach the tool case 45. The user removes the bands 41 from the case receiver member 37 and then detaches the tool case 45 from the case receiver member 37. Now, the user can carry out maintenance of the engine 12 using the tool kit 46 accommodated in the tool case 45.

In above described configuration, since the tool case 45 is attached on the inward wall surface 28 of the opened engine hood 22 when the user opens the engine hood 22 to maintain the engine 12, the user can easily take out the tool kit 46 for maintenance. Therefore, maintenance efficiency improves. In addition, since the tool case 45, which has a weight, is attached on the inward wall surface 28 of the engine hood 22, which faces the engine room 9 and is located closer to the hinge member 31, the force exerted by the rider to raise up the engine hood 22 around the hinge member 31 can be reduced. Furthermore, since the tool case 45 inserted into the case receiver members 37 forming the concave portions is pressed against the cushion member 40 and retained by the bands 41, it does not substantially move even when vibration occurs in the personal watercraft 1. As a result, generation of a noise can be inhibited.

While in this embodiment, the tool case mounting portion 47 is mounted on the inward wall surface 28 which is the front surface of the engine hood 22 which faces the engine room 9, it may alternatively be mounted on a wall surface (e.g., upper face, both side faces or rear face) other than the front surface. In addition, the cushion member 40 for absorbing vibration may be omitted so long as the tool case 45 can be stably retained. Furthermore, the shape of the tool case mounting portion 47 is not intended to that illustrated in this embodiment, and the tool case 45 may be fixed to the tool mounting portion 47 by any suitable means other than the bands 41.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

a body including a hull and a deck covering the hull from above;

an engine room formed in an interior of the body;

an engine hood mounted over an opening that is formed on the deck to be located at an upper region of the engine room, the engine hood being configured to open and close the opening; and a tool case mounting portion mounted on a wall surface of the engine hood which faces the engine room, the tool case mounting portion being configured to removably hold a tool case that accommodates a tool kit for the watercraft;

wherein the engine hood is mounted at an end portion thereof to the body by a hinge member and is configured to be vertically pivotable to be opened and closed, and the tool case mounting portion is mounted on the wall surface of the engine hood which is located on a hinge member side;

wherein a pair of swelling portions are configured to protrude from the wall surface of the engine hood which faces the engine room and are located on both sides of the tool case mounting portion; and wherein air ducts are respectively disposed in interiors of the swelling portions.

2. A personal watercraft comprising:

a body including a hull and a deck covering the hull from above;

an engine room formed in an interior of the body;

an engine hood mounted over an opening that is formed on the deck to be located at an upper region of the engine room, the engine hood being configured to open and close the opening; and a tool case mounting portion mounted on a wall surface of the engine hood which faces the engine room, the tool case mounting portion being configured to removably hold a tool case that accommodates a tool kit for the watercraft;

wherein the engine hood is mounted at an end portion thereof to the body by a hinge member and is configured to be vertically pivotable to be opened and closed, and the tool case mounting portion is mounted on the wall surface of the engine hood which is located on a hinge member side;

wherein the tool case mounting portion includes a pair of case receiver members each of which is mounted on the wall surface of the engine hood and is configured to form a concave portion, and a cushion member that is attached on the wall surface of engine hood and is located between the case receiver members; and wherein, with the tool case inserted into the concave portion of each of the case receiver members and an outer surface of the tool case on the case receiver member side pressed against the cushion member, the tool case is configured to be retained in such a manner that a band is applied to an outer surface of the tool case which is on an opposite side of the outer surface on the case receiver side, and both end portions of the band are engaged with both end portions of the case receiver member.

3. A personal watercraft comprising:

a body including a hull and a deck covering the hull from above;

an engine room formed in an interior of the body;

an engine hood mounted over an opening that is formed on the deck to be located at an upper region of the engine room, the engine hood being configured to open and close the opening; and a tool case mounting portion mounted on a wall surface of the engine hood which faces the engine room, the tool case mounting portion being configured to removably hold a tool case that accommodates a tool kit for the watercraft;

wherein the engine hood is mounted at an end portion thereof to the body by a hinge member and is configured to be vertically pivotable to be opened and closed, and the tool case mounting portion is mounted on the wall surface of the engine hood which is located on a hinge member side;

wherein the engine hood has, at a front portion thereof, a protruding portion extending downward from an inner surface of an upper wall thereof wherein the protruding portion has an inward wall surface forming a front surface of the engine room which faces the engine room and an outward wall surface located forward of the inward wall surface; and wherein the tool case mounting portion is mounted on the inward wall surface and the hinge member is mounted on the outward wall surface.

* * * * *